US006265595B1

(12) United States Patent
Taniguchi et al.

(10) Patent No.: US 6,265,595 B1
(45) Date of Patent: Jul. 24, 2001

(54) METHOD OF SOLVENT FRACTIONATION OF FAT

(75) Inventors: Atsushi Taniguchi; Shin Yoneda; Yuji Kuwabara; Tokisane Kajiyama, all of Izumisano (JP)

(73) Assignee: Fuji Oil Company, Limited, Osaka-fu (JP)

( * ) Notice: Subject to any disclaimer, the term of this patent is extended or adjusted under 35 U.S.C. 154(b) by 0 days.

(21) Appl. No.: 09/509,689

(22) PCT Filed: Sep. 30, 1998

(86) PCT No.: PCT/JP98/04423

§ 371 Date: Mar. 30, 2000

§ 102(e) Date: Mar. 30, 2000

(87) PCT Pub. No.: WO99/16853

PCT Pub. Date: Apr. 8, 1999

(30) Foreign Application Priority Data

Sep. 30, 1997 (JP) ..... 9-265725

(51) Int. Cl.[7] ..... C11B 7/00

(52) U.S. Cl. ..... 554/208; 554/206; 554/211

(58) Field of Search ..... 554/211, 206, 554/208

*Primary Examiner*—Deborah D. Carr

(74) *Attorney, Agent, or Firm*—Wenderoth, Lind & Ponack, L.L.P.

(57) ABSTRACT

A method of solvent fractionation of a fat by which a high fat concentration, a rise in refrigerant temperature, and a reduction in operation time, etc. can be attained and fractions are efficiently produced at a low cost, characterized by rapidly cooling a feedstock fat dissolved in a solvent to a temperature higher by 1 to 20° C. than the crystallization temperature used in a crystallizer in the step prior to introduction of the feedstock fat into the crystallizer.

4 Claims, No Drawings

METHOD OF SOLVENT FRACTIONATION OF FAT

This application is a 371 of PCT/SP98/04423 filed Sep. 30, 1998.

TECHNICAL FIELD

The present invention relates to a method of solvent fractionation of a fat. More specifically, it relates to a novel solvent fractionation method characterized in that a fat dissolved in a solvent is rapidly cooled in a pre-cooling device prior to crystallization such that the fat comes just close to crystallization or a blockade of the pre-cooling device does not occur, and the fat is then crystallized in a crystallizer in an efficient manner, for example, within a shorter period of time, with better quality, or with a larger amount to be treated.

BACKGROUND ART

Many methods for fractionating components of a feedstock fat are known, including methods of dry fractionation and methods of solvent fractionation. The steps of the methods of dry fractionation, which do not use any solvent, are relatively simple. However, the methods have drawbacks concerning the low purity of the fat component of interest or the difficulty in operating the fractionation steps. The methods of solvent fractionation advantageously overcome the above-mentioned drawbacks of the methods of dry fractionation, but have other drawbacks such as a long operation time due to an increased cooling load resulting from a high concentration of a fat dissolved in a solvent.

JP-B 38-917, for example, describes a method of solvent fractionation-crystallization of a fat comprising treating a fat in a rapid heat exchanger. This method is different from the method of the present invention in that the pre-cooling is performed below the crystallization temperature. Although the method of the publication is not defined by the yield of crystals based on the total amount of the fat at the crystallization temperature of the feedstock fat, the yield of around 8% described in Examples of the publication is quite different from that of 20% or higher obtained by the method of the present invention. The ratio of the total cooling load to the load for removing heat of crystallization in a crystallizer obtained by the method of the publication is 1, which is different from that obtained by the method of the present invention. The method of the publication is also different from the method of the present invention in that the method is not defined by the temperature of a refrigerant used in the crystallization.

When a feedstock fat which yields 20% or higher of crystals based on the total amount of the fat at the crystallization temperature is crystallized according to the method described in JP-B 38-917, deposition of crystals occurred before the temperature reached the crystallization temperature even if a rapid cooling was applied. Introduction of the feedstock fat in such a state into a crystallizer resulted in deposition of unnecessary components as constituents of crystals. Accordingly, a product with the objective quality was not obtained. These results are construed as follows. If a feedstock fat which yields 20% or higher of crystals is crystallized, a step of crystal growth should be usually performed slowly in order to avoid the formation of crystals before reaching the crystallization temperature. However, the step was performed rapidly. As a result, the incorporation of unnecessary components etc. occurred, which resulted in a failure in obtaining a product with the objective quality.

DISCLOSURE OF INVENTION

The present inventors have studied intensively in order to solve the problems listed in Background Art. As a result, it has been found that a high fat concentration can be attained, that the temperature of a refrigerant can be raised, and the operation time can be shortened in a method of solvent fractionation of a fat. Thus, the present invention has been completed. Therefore, the object of the present invention is to provide an efficient method of production in which the crystallization time in a crystallizer is shortened, the yield of crystals is increased and the like.

The method of solvent fractionation of fat of the present invention is characterized in that a feedstock fat dissolved in a solvent is rapidly cooled to a temperature higher by 1 to 20° C. than the crystallization temperature used in a crystallizer in the step prior to introduction of the feedstock fat into the crystallizer.

BEST MODE FOR CARRYING OUT THE INVENTION

In the method of the present invention, steps immediately prior to the crystallization in crystallization procedure is performed while cooling in a cooling device set up in the step prior to the crystallization. This method is particularly effective when a feedstock fat which yields 20% or higher of crystals at the crystallization temperature is used. On the other hand, practically, a yield which is too high, for example 80% or higher, may make the method less operative. In the cooling step, because it is required to cool the fat to a temperature which is higher than the crystallization temperature and as close to the crystallization temperature as possible in order to avoid crystallization at the outlet of the cooling device, the fat is rapidly cooled to a temperature higher by 1 to 20° C. than the crystallization temperature.

Specifically, it is required to set the cooling temperature such that the total cooling load in the crystallizer is in the range of 1.5 times to twice its load for removing heat of crystallization, although it correlates with the pre-cooling temperature. When the total cooling load is below 1.5 times its load for removing heat of crystallization, deposition of crystals may occur upon cooling, which may make it difficult to obtain a product with the objective quality due to the blockade of the cooling device or deposition of unnecessary components upon crystallization. When the total cooling load is above twice its load for removing heat of crystallization, the cooling load in the crystallizer becomes too large to expect an efficient operation of the crystallizer.

The crystal portion of the fat obtained by the method of the present invention can be utilized for foodstuffs and other non-foodstuffs. For example, it can be utilized as a fat for chocolate. Similarly, the liquid portion of the fat can be utilized for foodstuffs and other non-foodstuffs. For example, it can be used as a fat for fried food, or as a fat for margarine after hydrogenating the liquid portion of the fat.

Now the elements constituting the present invention are described hereinbelow.

The type of the solvent is not specifically limited as long as it dissolves a vegetable oil, an animal oil or any feedstock fat containing it. The typical examples of the solvent practically used include hexane, acetone, methyl ethyl ketone, and any mixture thereof. A solvent suitable for the object is preferably selected at each time of performance.

The feedstock fat is not specifically limited as long as it is a vegetable oil, an animal oil or a mixture thereof. The typical examples of the feedstock fat practically used include one which contains much of intermediate melting point fraction. Palm olein, palm oil, palm kernel oil and the like are desirable.

The range of the concentration of the feedstock fat dissolved in the solvent is not specifically limited. Practically, it is desirable to make the concentration as high as possible in order to increase the amount to be treated. Alternatively, the concentration of the fat is preferably selected at each time of performance so as not to interfere with the operation by the blockade of the pre-cooling device or, in particular, of the crystallizer after crystallization.

The pre-cooling device may be any heat exchanger. Preferably, it may be a device which can cool the fat to just close to crystallization while allowing the fat to continuously run in a flow of the fat. The device is desirably equipped with a device having a heating function in order to completely dissolve the crystals depositing in the heat exchanger and in the pipe between the outlet of the heat exchanger and the inlet of the subsequent crystallizer.

The pre-cooling temperature may be any temperature which is higher by 1 to 20° C., preferably by 5 to 15° C., most preferably by 8 to 12° C. than the crystallization temperature used in the crystallizer in the subsequent step.

The cooling rate of the pre-cooling step may be any rate which is rapid, for example, within 3 minuites, preferably within 1 minuite, most preferably within 30 seconds.

The crystallizer may be of any structure which provides a uniform cooling crystallization, a preferable heat-transferring effect, an optimum stirring effect, a smooth migration for the pre-cooled mixture of the fat dissolved in the solvent. Although the crystallizer may be of vertical type or horizontal type, it is preferably of horizontal type and having a stirrer. For example, the crystallizer has a structure of a cylindrical and horizontal tank having an inlet and a part for fitting a thermometer on the top, an outlet at the bottom, and a stirring shaft in the horizontal direction in the center, the shaft having plural vanes, and the vanes having holes cut off to the position close to the stirring shaft and the vanes without such holes being positioned alternately. The desired volume of the crystallization tank can be suitably designed depending, in combination, on the length of the cylinder, the length of vanes, the number of vane arrays, the degree of curve, the area of holes in the vanes and the like.

The crystallization temperature in the crystallizer varies depending on the feedstock fat used and the product of interest, and, therefore, may be selected at each time of performance.

The temperature of a refrigerant used is lower by 15 to 0° C. than the crystallization temperature in the crystallizer.

The refrigerants include, but not limited to, for example, propylene glycol, ethylene glycol, calcium chloride and the like.

As described hereinabove, foodstuffs can be produced with low cost by shortening the crystallization time, increasing the yield of the crystals and the like according to the method of production of the present invention.

EXAMPLES

The following Examples and Comparative Examples further illustrate the present invention in detail, but are not to be construed to limit the scope thereof.

Example 1

1.28 kg of palm olein from which stearin had been removed by dry fractionation (IV 56.5) was mixed with 1.67 kg of n-hexane (ratio by weight, 1:1.3), and heated to 23° C. The mixture was passed through a spiral-type heat exchanger having a heat-transferring area of 0.3 $m^2$, subjected to heat exchange with a refrigerant at −14.5° C., and cooled to −2.6° C. within 18 seconds. 3 L of the cooled mixture was placed in a 5 L stainless beaker. The beaker was soaked in a refrigerant tank equipped with a cooler kept at −20° C., and crystallization was allowed to proceed until the temperature of the mixture in the beaker became −14.5° C. After crystallization, the mixture was filtered under vacuum using a ø185 mm Buchner funnel and a filter paper, and the separated crystals were washed with n-hexane of 1.2 times the volume of the fat used to give a crystal portion. The liquid obtained by the filtration under vacuum was combined with the filtrate obtained by washing the crystals to give a liquid portion. The IV of the resulting crystal portion and the liquid portion was 39.9 and 68.1, respectively. The yield of the crystals based on the total amount of fat was 41.1%.

Example 2 and Comparative Example 2

The crystallization time obtained by pre-cooling the fat and that obtained without pre-cooling was compared.

In Example 2, 1,800 kg of palm olein from which stearin had been removed by dry fractionation (IV 57) was mixed with 2,340 kg of n-hexane (ratio by weight, 1:1.3), and heated to 19.5° C. The mixture was passed through a spiral-type heat exchanger having a heat-transferring area of 24 $m^2$ subjected to heat exchange with a refrigerant at −22.5° C., and cooled to 0° C. within 15 seconds. The cooled mixture was cooled to −12° C. in a 5.4 $m^2$ jacketed horizontal crystallizer using a refrigerant at −22.5° C. After crystallization, the mixture was filtered using a Buchner funnel and washed to give a crystal portion and a liquid portion, as described in Example 1. The IVs of the crystal portion and the liquid portion were 40.2 and 67.7, respectively. The size of the crystals formed was uniform, and the liquid passed through the crystals smoothly upon filtration. The yield of the crystals was 38.9%, which is similar to that in Example 1.

On the other hand, in Comparative Example 2, the same mixture of palm olein and n-hexane was heated to 19.5° C. The mixture was directly cooled to −12° C. in a 5.4 $m^2$ jacketed horizontal crystallizer using a refrigerant at −22.5° C. without passing through a heat exchanger. The mixture was filtered using a Buchner funnel and washed to give a crystal portion and a liquid portion, as described above. The IVs of the crystal portion and the liquid portion were 40.2 and 68.0, respectively. The yield of the crystals was 39.0%.

The results are shown in Table 1. The crystallization time in Table 1 is the time required to cool to −12° C. from the introduction of the mixture of palm olein and n-hexane into the crystallizer. As a result, it was confirmed that a product with the same quality can be obtained in a shorter period of time by pre-cooling the fat. The treating time was shortened (70% (=64/89)), or the amount to be treated was increased (140% (=89/64)).

TABLE 1

| | Pre-cooling | IV of crystal portion | IV of liquid portion | Crystallization time (min) |
|---|---|---|---|---|
| Example 2 | + | 40.2 | 67.7 | 64 |
| Comparative Example 2 | – | 40.2 | 68.0 | 89 |

Example 3 and Comparative Example 3

The crystallization time obtained by pre-cooling the fat and that obtained without pre-cooling was compared.

In Example 3, 0.45 kg of palm kernel oil (IV 18.5) was mixed with 2.79 kg of acetone (ratio by weight, 1:6), and heated to 28° C. The mixture was passed through a spiral-type heat exchanger having a heat-transferring area of 0.3 $m^2$, subjected to heat exchange with a refrigerant at 1° C., and cooled to 9° C. within 18 seconds. The mixture was introduced into a 4 L jacketed crystallization tank and allowed to crystallize while cooling to 3° C. with a refrigerant at –5° C. The slurry which reached the crystallization temperature was filtered under vacuum using a Buchner funnel and the IV of the filtrate was measured. The yield of the crystals was 45.1%.

On the other hand, in Comparative Example 3, the same mixture of palm kernel oil and acetone was heated to 28° C., then directly introduced into a 4 L jacketed crystallization tank without passing through a heat exchanger and allowed to crystallize while cooling to 3° C. Filtration was carried out as described above and the IV of the filtrate was measured. The results are shown in Table 2. The crystallization time in Table 2 is the time required to cool to 3° C. from the introduction of the mixture of palm kernel oil and acetone into the 4L jacketed crystallization tank. The yield of the crystals was 45.3%.

As a result, it was confirmed that the crystallization of palm kernel oil can be also performed in a shorter period of time. The treating time was shortened (65% (=11/17)), or the amount to be treated was increased (155% (=17/11)).

TABLE 2

| | Pre-cooling | IV of crystal portion | IV of filtrate | Crystallization time (min) |
|---|---|---|---|---|
| Example 3 | + | 10.6 | 25.0 | 11 |
| Comparative Example 3 | – | 10.3 | 25.3 | 17 |

Industrial Applicability

As described hereinabove, the present invention has attained a method of solvent fractionation of a fat characterized in that a feedstock fat dissolved in a solvent is rapidly cooled to a temperature higher by 1 to 20° C than the crystallization temperature used in a crystallizer in the step prior to introduction of the feedstock fat into the crystallizer. By using this method, it is possible to crystallize a fat in a shorter period of time, with better quality and with a larger amount to be treated, and to produce a fractionated fat with higher yield and at lower cost.

What is claimed is:

1. A method of solvent fractionation of a fat characterized in that a feedstock fat which is palm olein, palm oil or palm kernel oil dissolved in a solvent is rapidly cooled within three minutes to a temperature higher by 1 to 20° C. than the crystallization temperature used in a crystallizer in the step prior to introduction of the feedstock fat into the crystallizer, wherein the yield of crystals of the feedstock fat based on the total amount of the fat at the crystallization temperature is 20% by weight or higher.

2. The method according to claim 1, wherein the total cooling load in the crystallizer is in the range of 1.5 times to twice its load for removing heat of crystallization.

3. The method according to claim 1, wherein the temperature of a refrigerant used is lower by 15 to 0° C. than the crystallization temperature in the crystallizer.

4. A method of solvent fractionation of a fat characterized in that a feedstock fat dissolved in a solvent is pre-cooled to just close to crystallization while allowing the feedstock fat to continuously run in a flow of a heat exchanger and it is successively distributed in plural crystallizers.

* * * * *